US007992330B2

(12) United States Patent
DaRif et al.

(10) Patent No.: US 7,992,330 B2
(45) Date of Patent: Aug. 9, 2011

(54) DISPLAY ASSEMBLY FOR PRINTED MATERIALS

(75) Inventors: Mary M. DaRif, Twinsburg, OH (US); Edwin P. Miller, Winthrop Harbor, IL (US)

(73) Assignee: The Sherwin-Williams Company, Cleveland, OH (US)

( * ) Notice: Subject to any disclaimer, the term of this patent is extended or adjusted under 35 U.S.C. 154(b) by 525 days.

(21) Appl. No.: 12/037,182

(22) Filed: Feb. 26, 2008

(65) Prior Publication Data

US 2008/0209778 A1 Sep. 4, 2008

Related U.S. Application Data

(60) Provisional application No. 60/891,574, filed on Feb. 26, 2007.

(51) Int. Cl.

| | |
|---|---|
| ***G09F 1/10*** | (2006.01) |
| ***G09F 3/18*** | (2006.01) |
| ***G09F 3/20*** | (2006.01) |
| ***A47G 7/00*** | (2006.01) |
| ***A47G 29/10*** | (2006.01) |
| ***A47F 7/14*** | (2006.01) |
| ***A47F 7/00*** | (2006.01) |
| ***A47F 1/04*** | (2006.01) |
| ***B42F 17/02*** | (2006.01) |

(52) U.S. Cl. ..... 40/124.4; 40/124.2; 40/649; 40/657; 211/51; 211/50; 211/52; 211/55; 211/59.3; 211/49.1; 248/220.42; 248/221.11

(58) Field of Classification Search ..... 40/657, 40/124.4, 124.2; 211/50, 51, 52, 55, 59.3, 211/49.1; 248/220.42, 221.11
See application file for complete search history.

(56) References Cited

U.S. PATENT DOCUMENTS

| | | | | |
|---|---|---|---|---|
| 4,003,470 | A | 1/1977 | Lagorio | |
| 4,217,985 | A | 8/1980 | Nasgowitz | |
| 4,265,038 | A * | 5/1981 | Crosslen | 40/124.2 |
| 4,899,886 | A | 2/1990 | Johansen | |
| 4,982,852 | A | 1/1991 | Johansen | |
| 5,312,001 | A | 5/1994 | Sorensen | |
| 5,347,690 | A * | 9/1994 | Mansoor et al. | 24/295 |

OTHER PUBLICATIONS

Benchmarc Display, Inc. Button Attachment Chip Pocket drawing.

* cited by examiner

*Primary Examiner* — Joanne Silbermann
*Assistant Examiner* — Syed A Islam
(74) *Attorney, Agent, or Firm* — Deron A. Cook; Robert E. McDonald; Eryn Ace Fuhrer

(57) ABSTRACT

A display for printed materials includes a pocket mounting panel having a plurality of indexing holes, which may be arranged in columns and rows, and a plurality of pockets adapted to receive printed materials. The pockets include at least one rearwardly extending pocket engaging clip having a resiliently deformable member that is adapted to be received by an indexing hole. Pockets may be installed in a vertically cascading arrangement and individual pockets may be removed from the pocket mounting panel without removing adjacent installed pockets by manually engaging and deforming the resiliently deformable member(s) of the target pocket through access windows provided in the rear panels of the pockets.

19 Claims, 10 Drawing Sheets

DISPLAY ASSEMBLY FOR PRINTED MATERIALS

I. BACKGROUND OF THE INVENTION

A. Field of Invention

The present invention relates to displays for printed materials and in more specific embodiments to displays for paint color cards.

B. Description of the Related Art

Displays for printed materials, including, for example, paint color cards, are readily found in retail stores and libraries, amongst other places. Within its particular context, several different types of displays have been developed for facilitating the storage, display, and dispensing of paint color cards. Some designs, such as those taught in U.S. Pat. Nos. 5,312,001 and 4,003,470, incorporate pockets that are mounted to a panel. The pockets are adapted to hold a number of paint color cards, which may be removed by prospective customers.

In use, these pockets can be damaged, necessitating their replacement. Existing designs, however, incorporate barriers to easy and quick installation and removal of pockets from the display. For example, in some displays, the pockets are integral with the panel and cannot be removed or replaced without replacing the entire panel or section of the panel. In other designs, pockets may be mounted to the display with mechanical fasteners that require tools for removal. In still other displays, it is necessary to access the back of the panel or display in order to remove a pocket. This entails partially disassembling the display or otherwise moving the display so that the back of the panel is reachable. During this time, the entire display may be unusable.

Removing pockets is particularly difficult in designs that include a cascading arrangement of pockets; namely, an arrangement where adjacent pockets overlap each other. In these arrangements, the means of attaching the pocket may be rendered inaccessible by the adjacent, overlapping pocket(s). Or, the adjacent pockets may physically inhibit the removal or installation of a pocket. Under these conditions, removing one pocket requires removing adjacent pockets in order to provide sufficient access to or room around the one pocket that needs to be removed. This inhibits timely replacement of pockets.

It would, therefore, be desirable to provide a display for printed materials, such as paint color cards, that includes pockets for holding the printed materials that can be removed from and installed onto the display without need of tools. It would be desirable that the pockets could be removed and installed from in front of the display and without the need to access or remove the back of the display or the panel holding the pockets. It would additionally be desirable that the pockets could be removed and installed in a cascading arrangement in order to increase the density of pockets in the display. Moreover, it would be desirable if the pockets could be installed and removed without the need to remove adjacent card pockets or other sections of the display. Additionally it would be desirable if the display permitted the mounting of pockets having different dimensions so that a single display could be used to display different sized materials simultaneously.

The presently described display addresses these problems by disclosing a display that includes a pocket mounting panel and one or more card pockets that can be selectively installed in a cascading arrangement on the pocket mounting panel without the need for tools, from the front of the panel, and without the need to remove adjacent, installed card pockets.

II. SUMMARY OF THE INVENTION

According to one aspect of the present invention a display apparatus includes a pocket mounting panel that has at least one indexing hole and a card pocket that has a frame with a rear panel and at least one panel engaging clip connected to and extending rearwardly from the frame. The panel engaging clip includes a resiliently deformable member adapted to extend at least partially through the first indexing hole on the pocket mounting panel and to operatively engage the pocket mounting panel. The resiliently deformable member may include an extension tab that extends forwardly from the pocket mounting panel and is operatively manually engageable to deform the resiliently deformable member sufficiently to disengage the resiliently deformable member from the indexing hole. The resiliently deformable member may be a U-shaped member. The panel engaging clip may also include an extension member that extends between the frame and the resiliently deformable member. The extension member may extend rearwardly from the frame at an angle of from about 5 degrees to about 30 degrees from vertical with respect to the rear panel of the frame.

The frame and/or rear panel of the frame of the installed card pocket may cant forward from the pocket mounting panel at an angle of from between about 0 and about 60 degrees. The rear panel of the frame may include at least a first access window through which an associated user can operatively manually engage the extension tab to deform the resiliently deformable member sufficiently to disengage the resiliently deformable member from the indexing hole.

According to yet another aspect of the invention, a display apparatus includes a pocket mounting panel having at least two vertically adjacent indexing holes and at least two card pockets, each card pocket having a frame with a rear panel, and at least one panel engaging clip connected to and extending rearwardly from the frame. The panel engaging clip may include a resiliently deformable member that is adapted to extend at least partially through one of the indexing holes on the pocket mounting panel and to operatively engage the pocket mounting panel. The resiliently deformable member may be manually engageable from in front of the pocket mounting panel to deform the resiliently deformable member sufficiently to disengage the resiliently deformable member from the indexing hole. The first pocket card may be installed on the pocket mounting panel by means of the engagement of its resiliently deformable member in the first indexing hole and the second pocket card may be installed on the pocket mounting panel by means of the engagement of its resiliently deformable member in the second indexing hole. The two card pockets may be installed in a vertically cascading arrangement. The rear panels of the frames of the two card pockets may include at least one access window through which an associated user can operatively manually engage the resiliently deformable member of each of the two installed card pockets sufficiently to disengage the resiliently deformable members of each of the two installed card pockets from the respective indexing holes in the pocket mounting panel.

According to another aspect of the invention, the display may include a pocket mounting panel having at least three indexing holes, with the first, second and third indexing holes being arranged in a column, and at least three card pockets installed on the pocket mounting panel by means of the engagement of their respective resiliently deformable members to indexing holes. The three card pockets may be installed in a vertically cascading arrangement.

According to another aspect of the inventions, the display may include at least three card pockets that each have at least two panel engaging clips, and a pocket mounting panel that includes a plurality of rows and columns of indexing holes. The indexing holes may be substantially equally spaced within each column and within each row, and each of the three card pockets may be installed on the pocket mounting panel by means of the engagement of the resiliently deformable members of their panel engaging clips in adjacent indexing holes on the pocket mounting panel.

According to still another aspect of the invention, the card pocket that is disposed in the middle of a vertically cascading arrangement of three card pockets is removable from the pocket mounting panel without the need to remove either of the vertically adjacent card pockets. The card pocket that is disposed in the middle of the vertically cascading arrangement of three card pockets may be removed from the pocket mounting panel by manually engaging the resiliently deformable members of the middle card pocket sufficiently to disengage the resiliently deformable members from the respective indexing holes and the resiliently deformable members of the middle card pocket may be accessible through the access windows in the rear panels of the middle card pocket and the adjacently lower card pocket. The card pocket that is disposed at the vertical top of the of the vertically cascading arrangement of three card pockets may be manually removed from the pocket mounting panel while the other two pocket cards remain installed. Access to manually remove the card pocket that is disposed at the vertical top of the vertically cascading arrangement may be provided through access windows in the rear panels of each of the three card pockets.

According to another aspect of the invention, a method for removing a target paint chip pocket in a paint chip display includes providing a paint chip display that has a pocket mounting panel with a plurality of rows and columns of indexing holes, which may be substantially equally spaced apart, and providing a target paint chip pocket that is installed on the pocket mounting panel. The target paint chip pocket may include a frame having a generally planer rear panel with at least one access window, and at least one panel engaging clip connected to and extending rearwardly from the frame. The panel engaging clip may include a resiliently deformable member adapted to extend at least partially through one of the indexing holes on the pocket mounting panel and to operatively engage the pocket mounting panel. The method may further include manually engaging the resiliently deformable member of the target paint chip pocket through the access window in the rear panel of the target paint chip pocket; deforming the resiliently deformable member sufficiently to disengage the resiliently deformable member from the indexing hole; and removing the resiliently deformable member from the indexing hole.

According to still another aspect of the invention, the step of providing a target paint chip pocket installed on the pocket mounting panel comprises the step the providing a vertically cascading arrangement of paint chip pockets that includes a target paint chip pocket.

According to still another aspect of the invention, the target paint chip pocket is positioned vertically above at least one non-target paint chip pocket in the vertically cascading arrangement; and the step of manually engaging the resiliently deformable member of the target paint chip pocket, includes manually engaging the resiliently deformable member of the target paint chip pocket through the at least a first access window in the rear panel of the target paint chip pocket and an access window in the rear panel of the non-target paint chip pocket.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DETAILED DESCRIPTION OF THE INVENTION

Figure 1:
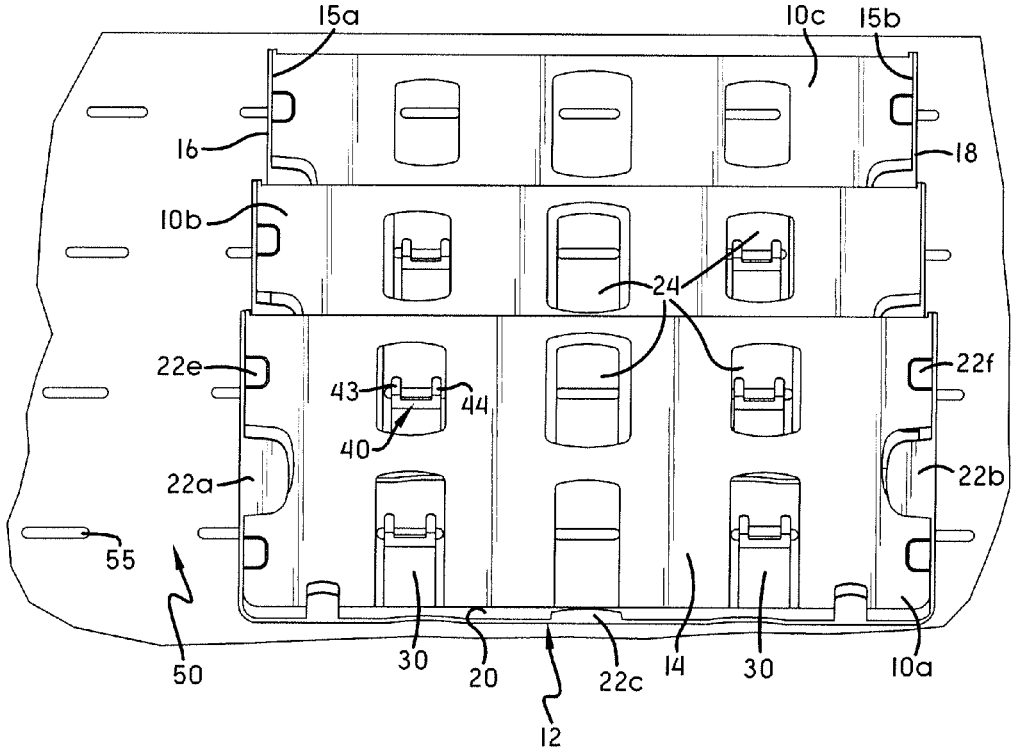
FIG. 1 is a front view of a portion of an informational display including three representative card pockets installed on a pocket-mounting panel.
Figure 2:
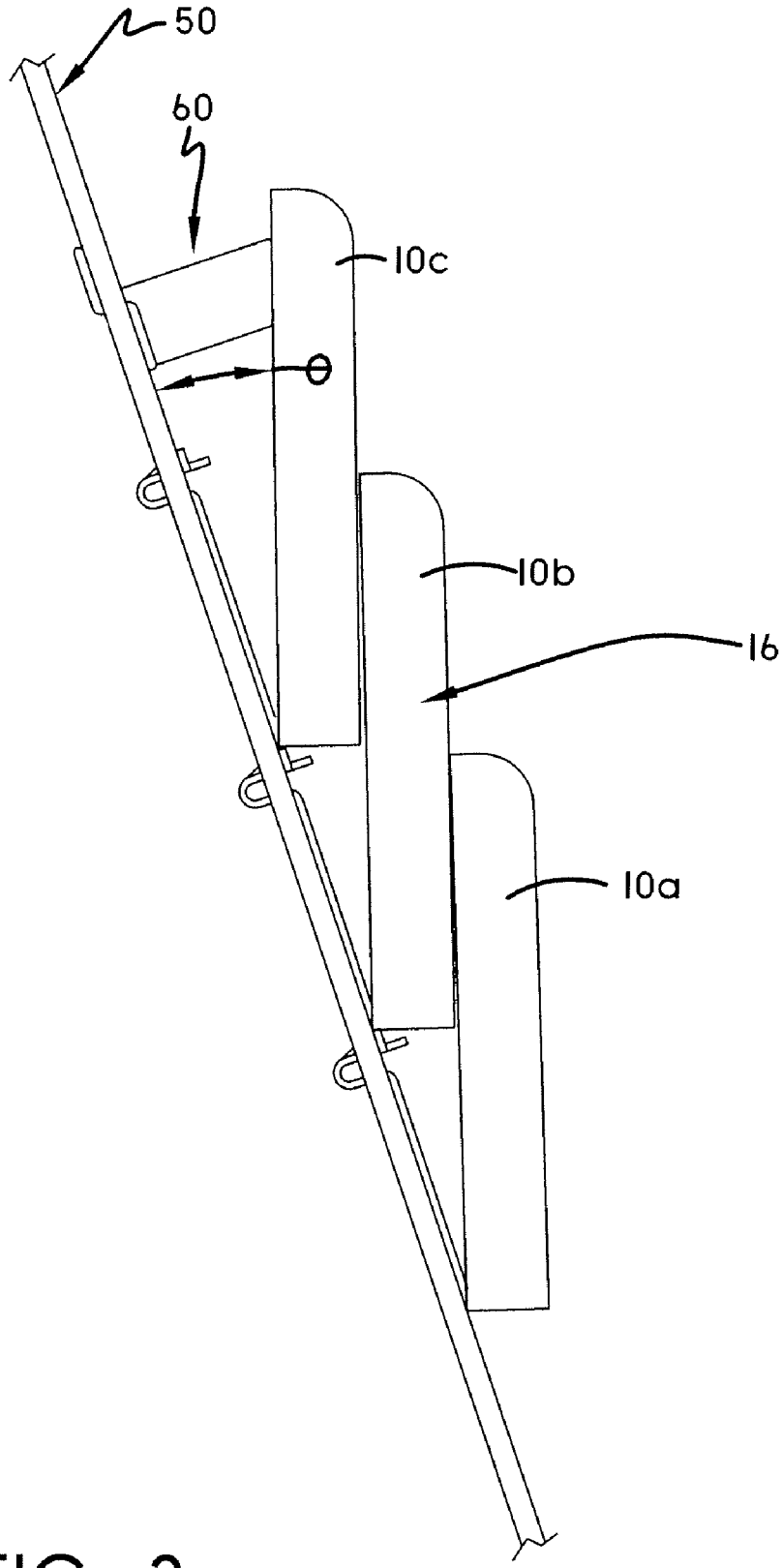
FIG. 2 is a side perspective of the portion of the informational display depicted in FIG. 1.
Figure 3:
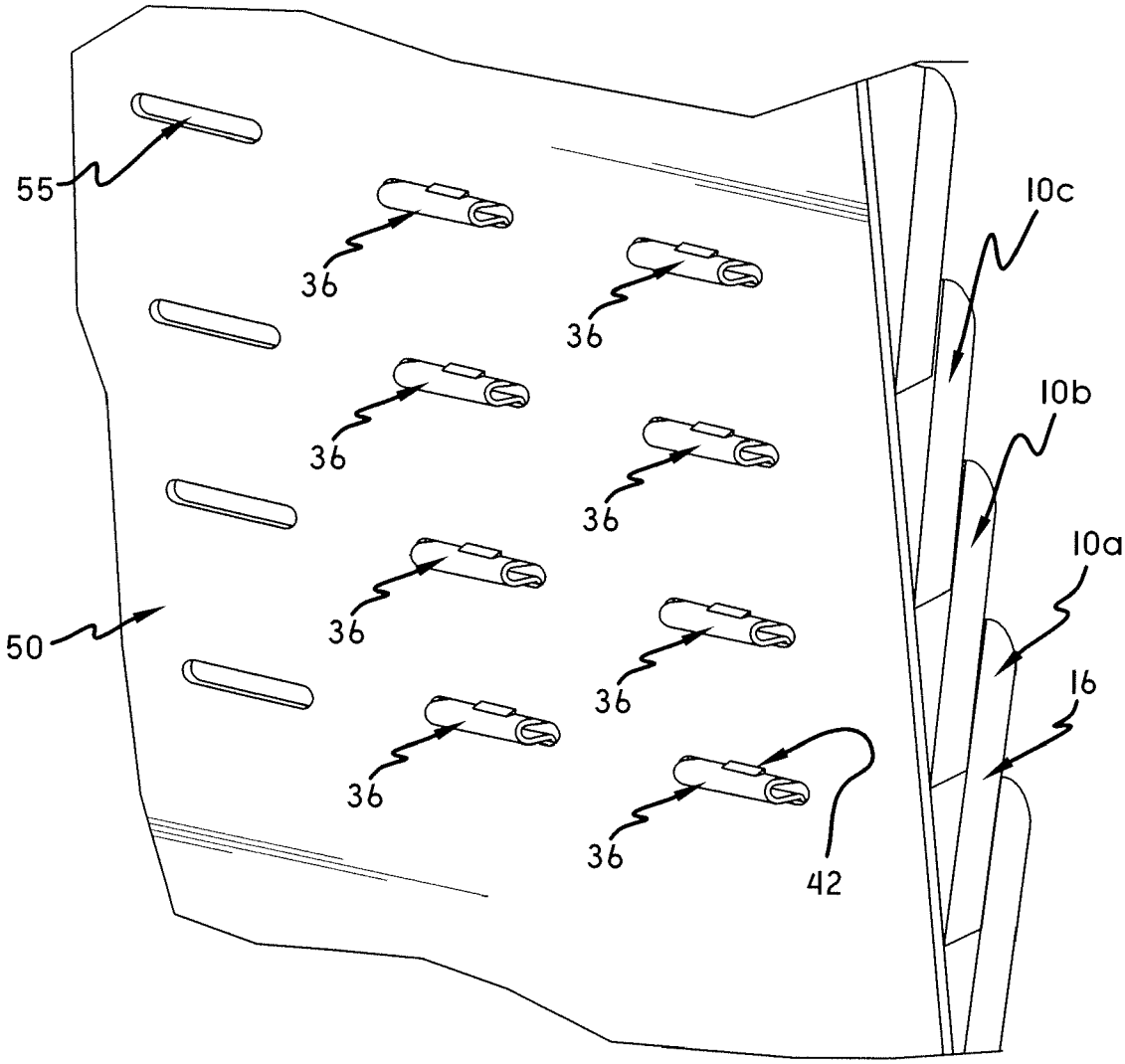
FIG. 3 is a rear perspective of the portion of the informational display depicted in FIG. 1.
Figure 10:
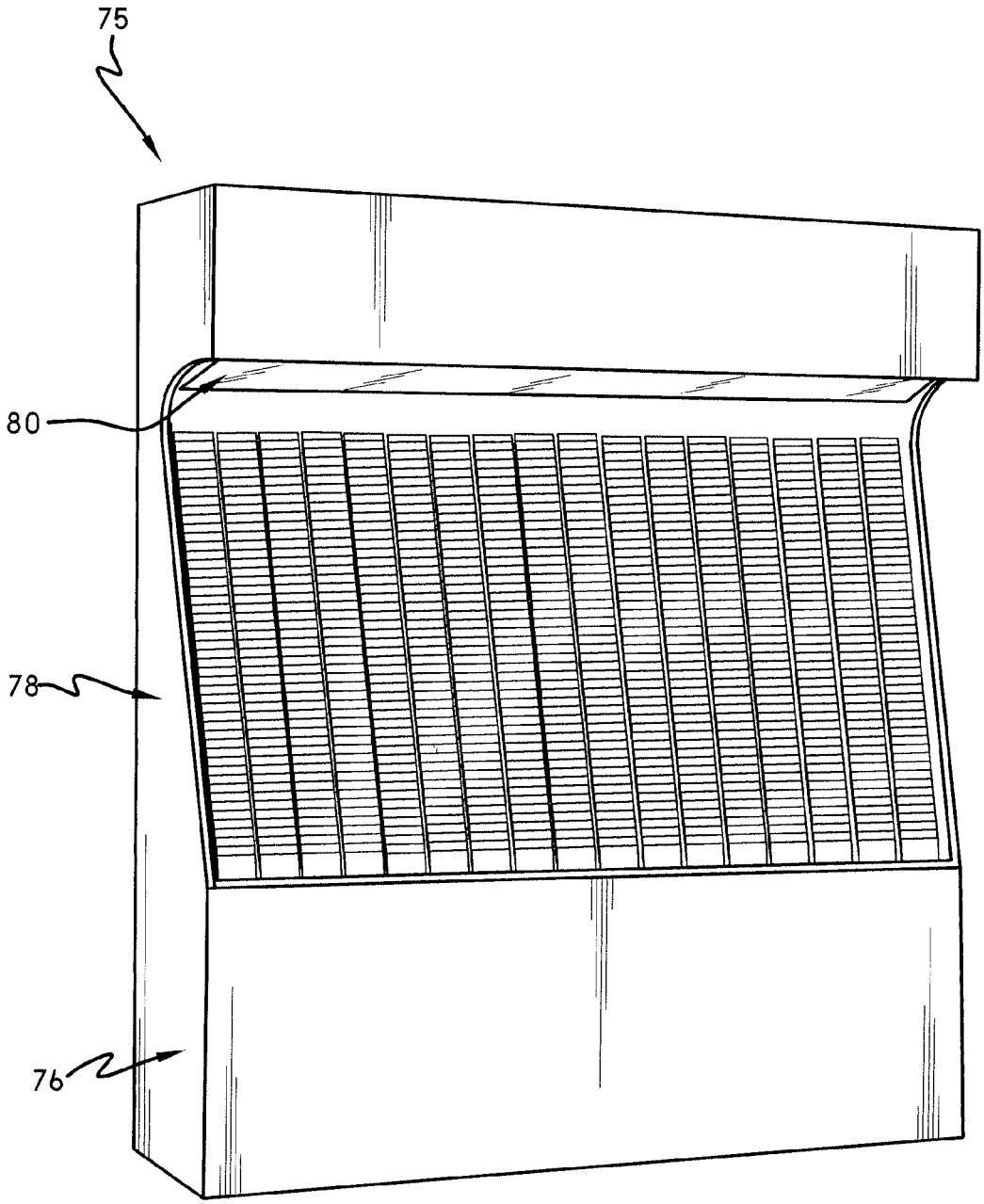
FIG. 10 is a front view of a paint card display.

Referring now to the drawings wherein the showings are for purposes of illustrating embodiments of the invention only and not for purposes of limiting the same, FIGS. 1, 2 and 3 show a portion of an apparatus for displaying printed materials, such as paint color cards, also known as paint chips, that includes one, and in other embodiments, a plurality of card pockets 10 that may be selectively, removably positioned on a pocket mounting panel 50, and may be installed and removed from the pocket mounting panel 50 without the need for tools or mechanical fasteners, such as screws or bolts. Preferably, though not necessarily, a plurality of card pockets, exemplified by card pockets 10*a*, 10*b*, and 10*c* in FIGS. 1-3 can be installed in a vertically cascading arrangement on the pocket mounting panel 50; that is, installed so that each card pocket, for example, card pocket 10*a*, at least partially overlaps the card pocket 10*b* that is installed immediately above. The card pockets 10 may be removed and installed by one having access only to the front of the pocket mounting panel 50 and without the need to uninstall adjacent card pockets 10. As shown in FIG. 10, the pocket mounting panel 50 may be a part of an informational display 75 (described later) for displaying the card pockets 10, and more specifically, the printed materials disposed in the card pockets 10.

Figure 4:
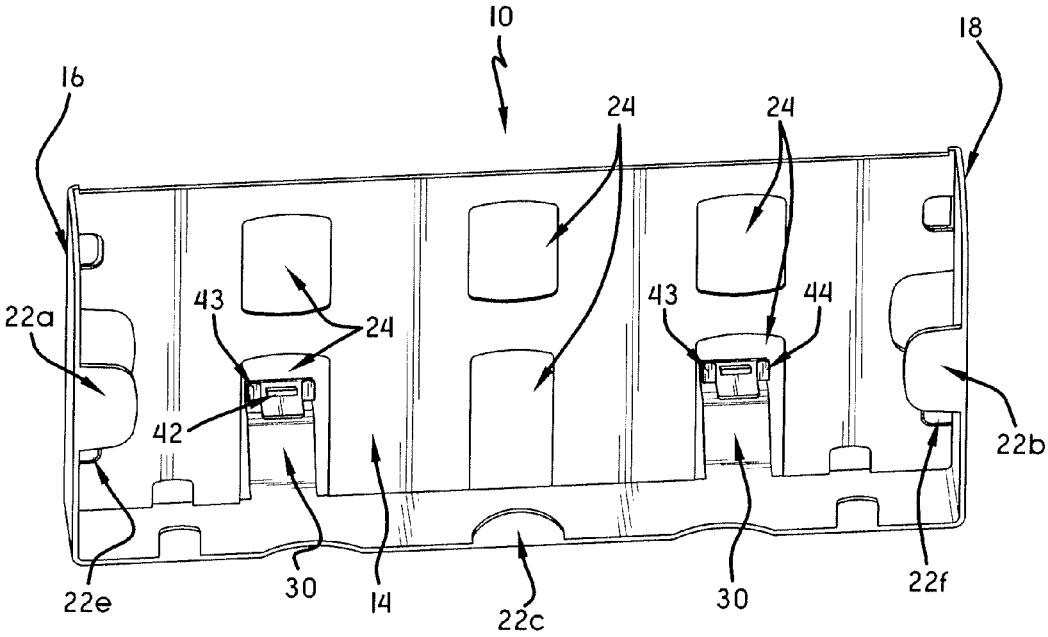
FIG. 4 is a front view of a representative card pocket.
Figure 5:
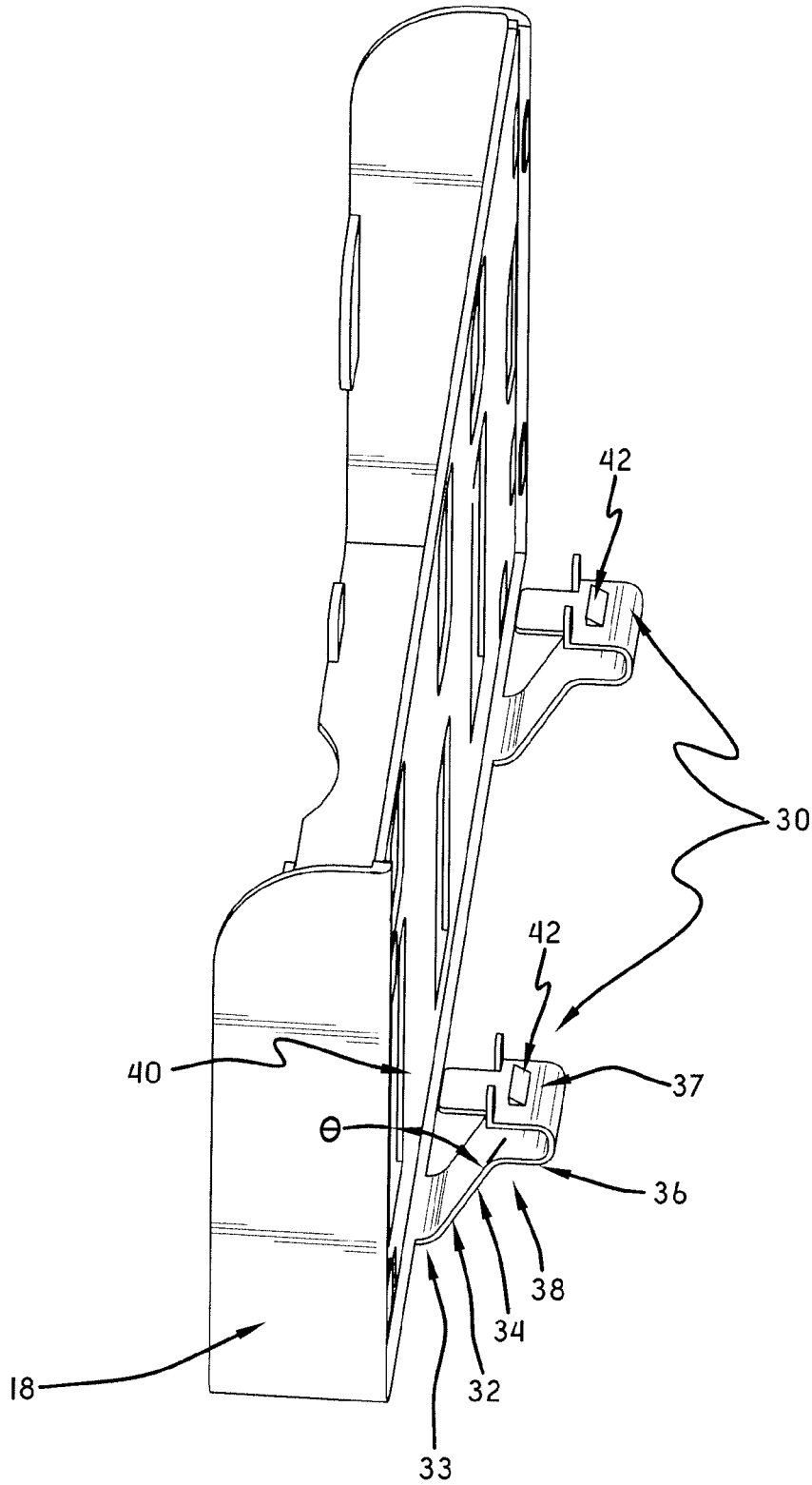
FIG. 5 is a side view of a representative card pocket.
Figure 6:
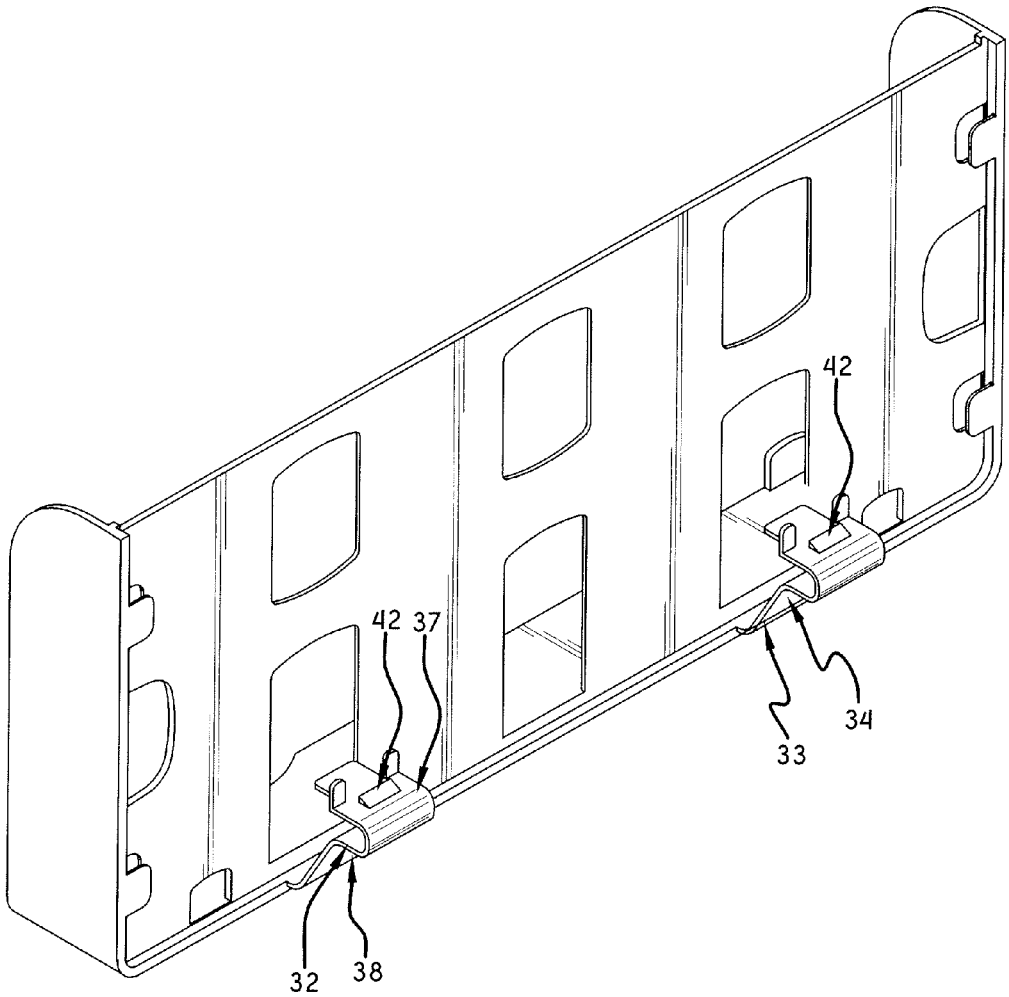
FIG. 6 is a rear view of a representative card pocket.

One embodiment of a representative card pocket 10 is depicted in FIGS. 4-6 and includes a frame 12. The frame 12 has a rear panel 14, which may be generally planer, and may further include first and second side panels 16,18 projecting at least forwardly and substantially perpendicularly from the side edges 15*a*, 15*b* of the rear panel 14, and a bottom panel 20 projecting at least forwardly and substantially perpendicularly from the bottom edge 15*c* of the rear panel 14. Reference is made to the first and second side panels 16, 18 and bottom panel 20 as extending "at least forwardly" from the rear panel 14, to allow that in another embodiment it may be desirable for one or more of the first and second side panels 16, 18 and bottom panel 20 to additionally extend rearwardly from the rear panel 14 as depicted in FIGS. 5 and 6.

With continued reference to FIGS. 4-6, the frame 10 may further include one or more flanges 22*a*, 22*b*, 22*c* positioned along the forward or leading vertical edges of the first and second side panels 16, 18 and bottom panel 20. These flanges 22 may serve to restrain printed materials disposed in the frame 12, though it is desirable that the flanges 22 not prevent an associated user from taking printed materials from the card pocket 10. As depicted in FIG. 4, at least one flange 22 may be positioned substantially halfway along and adjacent the forward leading edge of the first and second side 16, 18; however, the location of the flanges 22 is not essential, as they primarily serve to restrain printed materials in the card pocket 10, and could perform a similar function in a variety of positions. In one embodiment it may be desirable to include additional flanges 22*d*, 22*e* positioned along and adjacent the rear or trailing vertical edges of the first and second side panels 16,18, particularly in embodiments where the trailing vertical edges of the first and second side panels 16, 18 extend rearwardly from the rear panel 14 (see FIG. 6). These additional flanges 22*d*, 22*e* may serve to restrain one or more pieces of printed material positioned behind the rear panel 14 of the frame 12.

Figure 7:
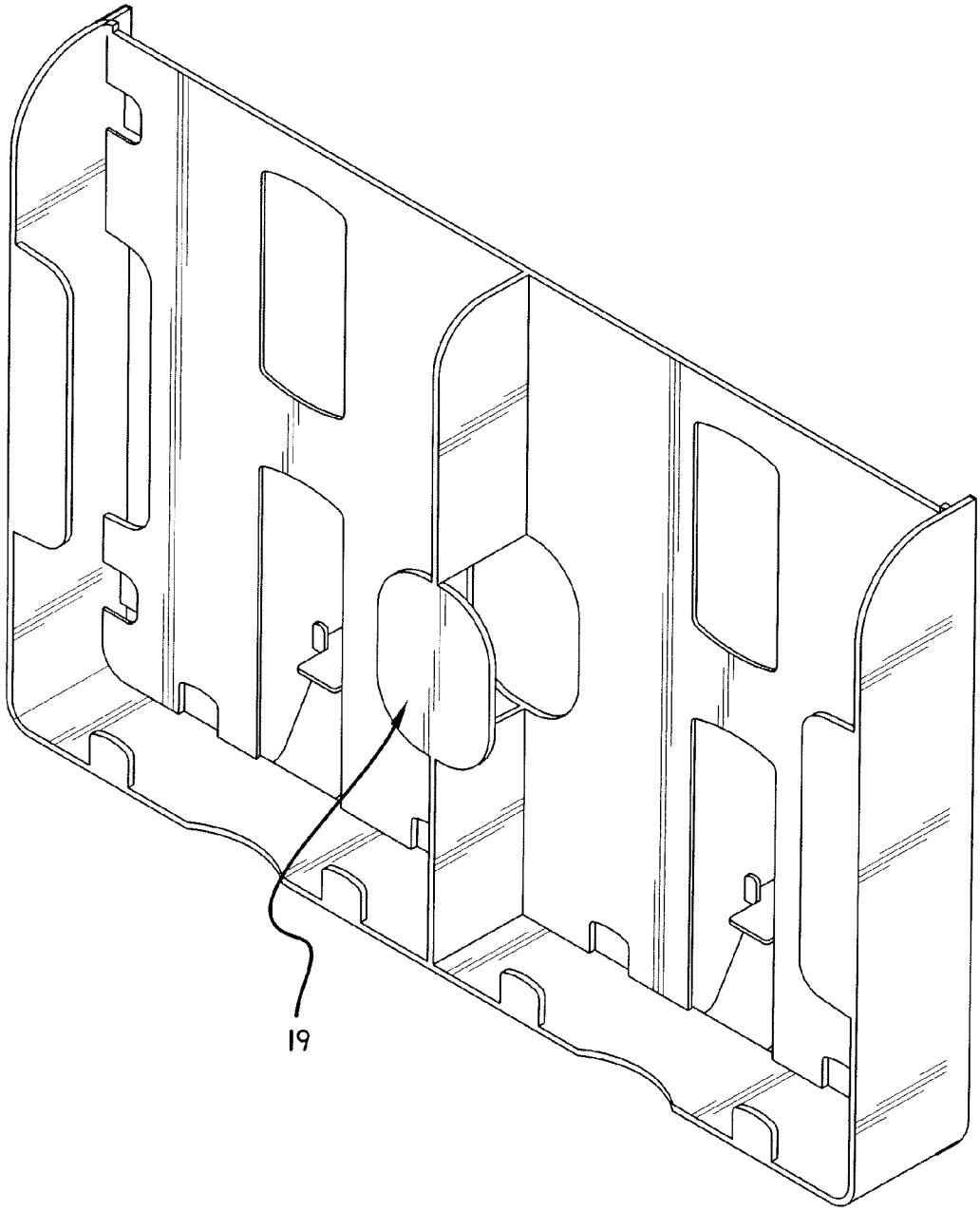
FIG. 7 is a front view of a representative bisected card pocket.

With specific reference to FIG. 7, a bisected card pocket is shown in which a bisecting panel 19, which may extend forwardly from the rear panel 14 or upwardly from the bottom panel 20, separates the card pocket 10 into two pockets. It will be recognized that a card pocket 10 may be sectioned into more than two pockets with additional such bisecting panels 19.

As described thus far, it is anticipated that the frame 12 will be constructed so as to define a pocket for printed materials that may be disposed therein, either in front of and/or behind the rear panel 14. It is desirable that the frame 12 readily allow for printed materials to be removed from and restocked into the pocket. It is also desirable that the frame 12 be constructed so as to restrain the printed materials from falling out. The flanges 22 previously described may operate to restrain the printed materials in the frame 12; however, it will be readily recognized that other methods of restraining the printed materials in the frame 12 in such a manner as to also permit the materials to be removed and restocked may be employed; for example, a band (not shown), which may be an elastic band or a rigid band, may extend across the frame 12, extending from side panel 16 to side panel 18.

The card pocket 10 may be constructed from a number of acceptable materials, including plastics and metals.

According to one embodiment, the card pocket 10 may be removably attached to a pocket-mounting panel 50 (discussed in further detail below, but depicted in FIGS. 1-3) in such a manner as to be removable and installable, preferably without the need for tools, without the need to access the rear of the pocket-mounting panel 50, without the need to disassemble the display 75, and without the need to remove adjacent, installed card pockets 10. Accordingly, as shown in FIGS. 1-6, the card pocket 10 further includes at least one pocket-mounting panel engaging clip 30, also referred to as a panel engaging clip, that is adapted to be removably received into an indexing hole 55 disposed in the pocket-mounting panel 50. The card pocket 10 may have a plurality of panel engaging clips 30. In one embodiment, the card pocket 10 may have two panel engaging clips 30, though three or more panel engaging clips may be used 30.

With reference to FIGS. 5 and 6, one embodiment of a panel engaging clip 30 is shown as including an extension member 32 having a first end 33 that is operatively affixed to the frame 12 and a second end 34 that is operatively affixed to a resiliently deformable member 36, such as a U-shaped member 36*a* shown in the Figures. The extension member 32 extends rearwardly from the frame 12. As shown in FIG. 5, the extension member 32 may extend rearwardly from the frame 12 at an angle θ of from about 5 degrees to about 85 degrees from vertical with respect to the rear panel 14 of the frame 12, and in other embodiments, about 5 degrees to about 60 degrees, or from about 5 degrees to about 45 degrees, or from about 5 degrees to about 30 degrees, or from about 10 degrees to about 30 degrees, all from vertical with respect to the rear panel 14. Such an angular rearward extension of the extension member 12 may allow the card pocket 10, when installed, to cant away from the forward face of the pocket mounting panel 50. Canting the card pocket 10 away from the pocket mounting panel 50 may be desirable to cause the installed card pocket 10 to sit more vertically in the display 75 or to facilitate proper illumination of the materials disposed in the card pockets 10. Canting the card pockets 10 also allows for vertical cascading of installed card pockets 10 as shown in FIGS. 1-3.

The extension member 32 may be affixed adjacent the bottom of the frame 12. In other embodiments, it may be desirable to affix the extension member 32 toward the vertical midline of the frame 12 or even the top of the frame 12. In yet another embodiment, the extension member 32 may extend rearwardly from the side(s) of the frame 12.

In one embodiment, the resiliently deformable member 36 may be a U-shaped member 36*a*. As shown in FIGS. 5 and 6, this U shaped member 36*a* may be disposed on its side so that its upper and lower arms 37, 38 are substantially perpendicular to the rear panel 14 of the frame 12, with the closed "bottom" of the "U" being rearward of the frame 12 from the open "top" or "mouth" of the "U". It will be recognized from FIGS. 5 and 6, that the upper and lower arms 37, 38 of the U-shaped member 36*a* may not be exactly parallel to each other or perpendicular to the rear panel 14 of the frame 12 and some angular variation from these respective contexts may be desirable. It will also be understood that though FIGS. 5 and 6 depict a horizontal arrangement of the arms 37, 38 of the U shaped member 36*a*, a substantially vertical arrangement of the arms 37, 38 may be selected.

The U-shaped member 36*a* may be adapted to be inserted into an indexing hole 55 in the pocket-mounting panel 50 and engage the walls of the pocket-mounting panel 50 that define the indexing hole 55. FIG. 1 shows a portion of one embodiment of a pocket-mounting panel 50. The pocket-mounting panel 50 may be any substantially planer, rigid sheet material, such as polycarbonate, polyvinylchloride, medium density fiberboard, and plywood. In a particularly useful embodiment, the pocket-mounting material 50 is plastic.

A plurality of indexing holes 55 may be formed in the pocket-mounting panel 50. The indexing holes 55 may serve to receive the panel engaging clip(s) 30 of the card pocket 10 and to position the card pocket 10 on the pocket-mounting panel 50. The indexing holes 55 may extend through the pocket-mounting panel 50. It will be recognized that the dimensions of the indexing holes 55 may be selected to snugly receive the panel engaging clips 30. In this respect, the specific length and height of the indexing holes 55 may vary depending on the dimensions of the panel engaging clip 30. It will also be recognized that the distance between the indexing holes 55 may be selected to accommodate card pockets 10 of different sizes or to provide different card pocket densities on the pocket-mounting panel 50.

FIG. 1 shows one arrangement of indexing holes 55 on a pocket-mounting panel 50. The indexing holes 55 may be arranged in a plurality of columns and rows, which columns and rows or indexing holes 55 may be substantially equally spaced apart. The width between columns may be selected to create alignment between adjacent indexing holes 55 and the panel engaging clips 30 on a card pocket 10, and additionally, to minimize space between adjacent card pockets 10. The spacing between rows may be selected to accommodate the thickness of the card pocket 10 and permit card pockets 10 to be closely packed together, preferably, though not necessarily, in a vertically cascading arrangement. By "vertically cascading arrangement" it is meant that each installed card pocket 10 is partially overlapped by at least one card pocket 10 installed adjacently below it. The overlap may be as little as 1 percent of the vertical height of the overlapped card pocket, though in other embodiments, the overlap may be from between 10 to 90 percent, or greater than 15 percent or 25 percent or 30 percent or 50 percent or 60 percent or 70 percent or 80 percent or 90 percent of the vertical height of the overlapped card pocket. Canting the card pockets 10 as described above, is one method for facilitating partial overlap of adjacent installed card pockets 10. In other embodiments, the arrangement of the indexing holes 55 may be such that each card pocket 10 is partially overlapped by from two to four card pockets 10 installed below it.

Figure 8:
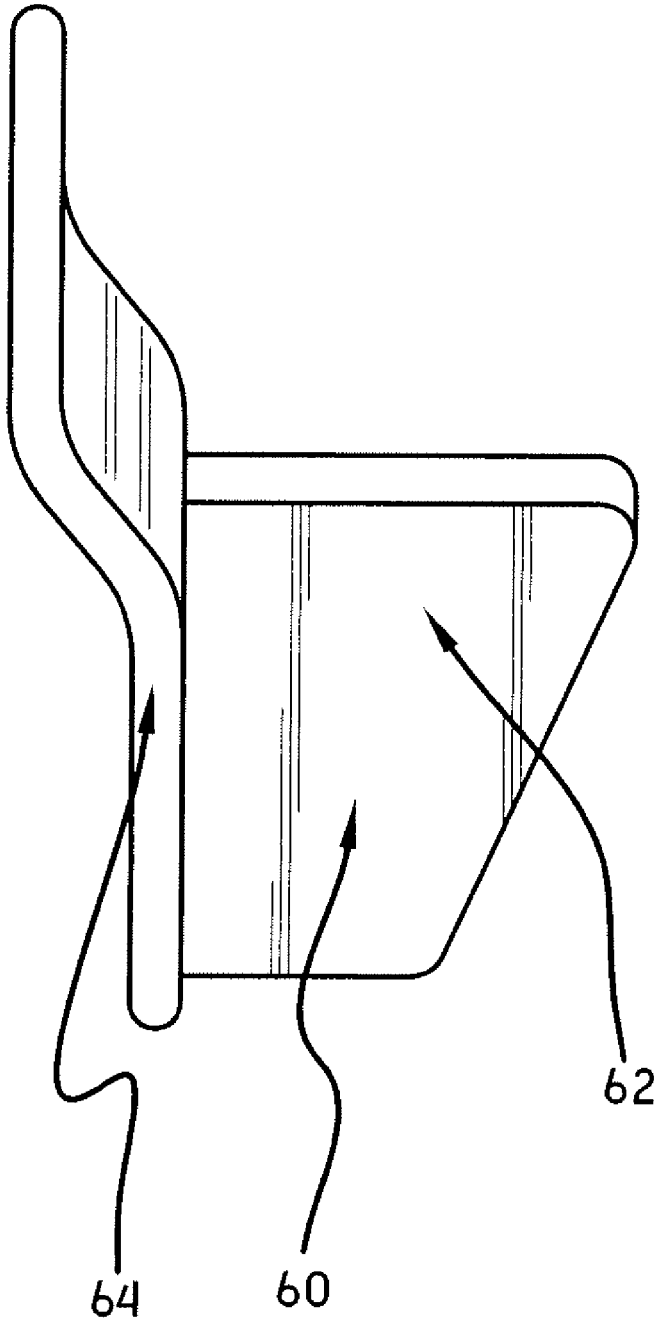
FIG. 8 is a side view of a representative spacer clip.

With reference to FIGS. 2 and 8, to limit displacement and potential damage resulting from force applied to card pockets 10 installed in a top row of installed card pockets, one or more spacer clips 60 may be positioned in indexing holes 55 located above the top card pocket 10. These spacer clips 60 are adapted to removably engage an indexing hole 55 and have a forward jutting portion 62 that will engage and support the back of the card pocket 10 when the installed card pocket 10 is pushed toward the pocket mounting panel 50. One embodiment of a spacer clip 60 is shown in FIG. 8 and includes an S-shaped portion 64 and a forward jutting portion 62 extending forward from the S-shaped portion 64.

With reference now to FIGS. 1 and 3, it will be seen that a panel engaging clip 30 may be received by an indexing hole 55 by pushing the resiliently deformable member 36 into the indexing hole 55. The resiliently deformable member 36 is deformable—meaning it may be compressed or otherwise altered in shape to fit at least partially through an indexing hole 55. The resiliently deformable member 36 is resilient—meaning it will resist deformation and substantially return to its original shape when outside forces are no longer being applied. The U-shaped member 36*a* is an example of a resiliantly deformable member 36 having these characteristics. The upper and lower arms 37, 38 of the U-shaped member 36*a* may be compressed toward each other manually or by the walls defining an indexing hole 55; however it is anticipated that the upper and lower arms 37, 38 will be resilient, namely, they will resist being compressed toward each other and will, on engagement with the indexing hole 55, resiliently press outwardly on the walls defining the indexing hole 55 thereby holding the card pocket 10 in place.

One or both of the arms 37, 38 of the U-shaped member 36*a* may include one or more tabs 42, 43, 44 arranged on the arm(s) 37, 38 to operatively engage the front and/or back faces of the pocket mounting panel 50 so as to prevent the U-shaped member 36*a* from being completely pushed through the indexing hole 55 and from readily backing out of the indexing hole 55 in the absence of further compression of the U-shaped member 36*a*. With reference to FIG. 3, rear panel engaging tab 42 is adjacent the back face of the pocket mounting panel 50 when the card pocket 10 is installed, and may be sufficiently tall so as to prevent the card pocket 10 from readily being pulled from the pocket mounting panel 50 without compressing the U-shaped member 36*a*, but sufficiently short so as not to impede removal or installation of the card pocket 10 when the U-shaped member 36*a* is compressed during card pocket installation or removal.

To remove an installed card pocket 10 from the pocket mounting panel 50, the associated user may manually compress or deform the arms 37, 38 of the U-shaped member 36*a* and pull the U-shaped member 36*a* out of the indexing hole 55. To facilitate access to manually deform the U-shaped member 36*a* from in front of the card pocket 10, one or more access windows 24 may be provided in the rear panel 14 of the frame 12 as shown in FIGS. 1, 4, 6 and 9. These access windows 24 not only provide access to the pocket engaging clips 30 of the immediately associated card pocket 10, but, in a vertically cascading arrangement of card pockets 10, the access windows 24 may allow access to the pocket engaging clips 30 of the card pocket 10 installed immediately above as shown in FIG. 1. The access windows 24 that provide access to the resiliently deformable member 36 may be sufficiently large to permit an associated user to use her fingers to manually deform the resiliently deformable member 36. The access windows 24 may further provide for the visualization of material placed behind the rear panel 14, though use of a transparent material for the rear panel 14 will also allow visualization of such material.

FIG. 1 depicts a vertically cascading array of three card pockets 10*a*, 10*b*, 10*c* such as might be installed in a display 75. The follow describes exemplary methods for selectively removing card pockets 10 from such an arrangement. Though three card pockets are shown in FIG. 1, it will be understood that the methods will be generally applicable in cascading arrangements of two or more card pockets and in non-cascading arrangements of card pockets. For purposes of the following descriptions, the term "target card pocket" refers to the card pocket to be removed from the pocket mounting panel.

Figure 9:
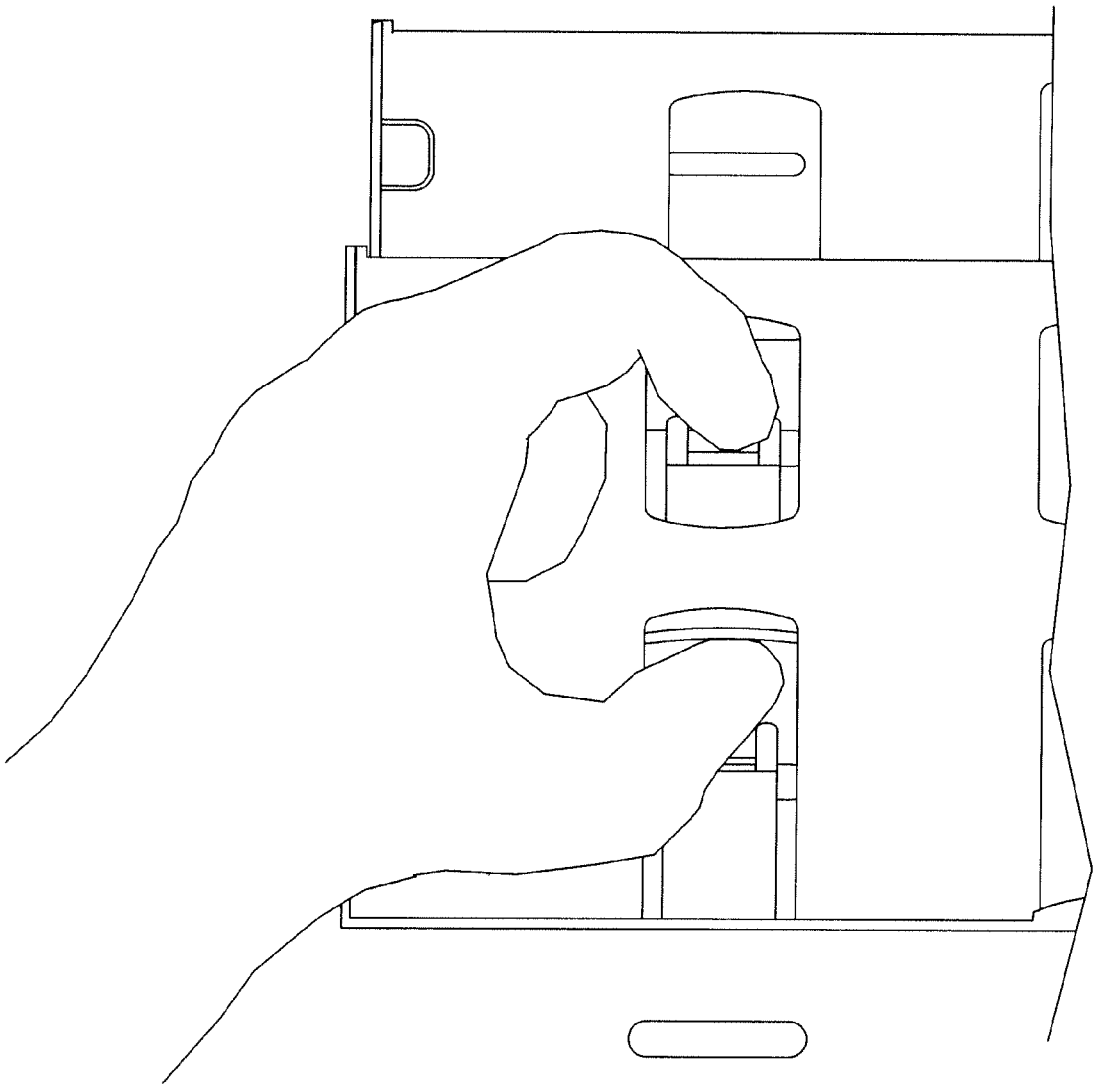
FIG. 9 depicts one method for manually engaging a panel-engaging clip.

To remove a target card pocket that is on the bottom installed row (for example, card pocket 10*a* in FIG. 1) may require removing the printed materials from the target card pocket 10*a*, reaching through the access windows 24 of the target card pocket 10*a* to manually engage the resiliently deformable member 36, deforming resiliently deformable member 36, such as, in one embodiment shown in FIG. 9, by pressing downward on the upper arm 37 of the U-shaped member 36*a* and simultaneously, upward on the bottom panel 20 of the frame 12, and pulling the target card pocket 10*a* from the pocket mounting panel 50. To facilitate manually engaging the upper arm 37 of the U-shaped member 36*a*, a forward extension tab 40 may be provided (as shown in FIGS. 1 and 5).

To remove a target card pocket that is in the middle of the cascading arrangement (indicated as 10*b* in FIG. 1) or at the top of the cascading arrangement of card pockets (indicated as 10*c* in FIG. 1), it may be necessary to remove the printed materials from the target card pocket 10*b*, and at least one, and possibly two card pockets that are immediately below the target card pocket. The associated user can access the resiliently deformable member 36 of the target card pocket 10*b* through the access windows 34 of the lower card pockets 10*a* and the target card pocket 10*b*. The resiliently deformable member 36 of the target card pocket 10*b* may be compressed as described above and shown in FIG. 9 and the target card pocket 10*b* may be pulled from the pocket mounting panel 50. Removal of adjacent installed card pockets 10*a*, 10*c* should not be necessary.

Installation of a new card pocket 10 includes positioning the card pocket 10 with its panel engaging clips 30 adjacent accessible indexing holes 55 and pressing the U-shaped members 36*a* of the panel engaging clips 30 into the respective indexing holes 55. The walls of the indexing holes 55 will engage and compress the U-shaped members 36*a*, though compression may be provided manually be the associated installer. It is contemplated that a new card pocket 10 may be installed within a vertically cascading arrangement of card pockets 10, assuming suitable indexing holes 55 are available, without having to remove vertically adjacent card pockets.

According to one embodiment, the card pocket 10 may be adapted to receive a plurality of paint color cards. Paint color cards are pieces of card or paper stock on which one or more samples of color representing or constituting one or more shades of paint or other architectural coating is displayed. Such cards are well known in the art and are not further described herein. Though the display of paint color cards is one anticipated application of the card pockets, it is contemplated that the card pockets 10 could be adapted for use in displaying other types of printed materials such as product brochures, advertising leaflets, rebate forms, and the like. Moreover, the card pockets 10 and associated display could be adapted to display a variety of non-printed materials, including non-printed media.

In one embodiment, the pocket mounting panel 50 may be affixed to a surface, such as a wall. In another embodiment, the pocket mounting panel 50 may be incorporated into a display 75, such as is often found associated with the sale of paint, for paint color cards. See FIG. 8. Such a display 75 may include a base unit 76. The base unit 76 may include a storage area for storing paint color cards or other materials. The display 75 may further include an upper unit 78 to which the pocket mounting panel 50 may be attached by any means selected with sound engineering judgment. The display 75 may further include a light 80, which may be direct or indirect lighting supplied by incandescent or fluorescent light bulbs or other light emitters. The light 80 may be disposed above the pocket mounting panel 50 so as to illuminate the card pockets 10 installed in the pocket mounting panel 50.

The base and upper units 76, 78 of the display 75 may comprise a unitary unit or, alternatively, they may exist as two distinct units attached together so that the upper unit 78 may be removed from the base unit 76.

The embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

We claim:

1. A display apparatus comprising:

a pocket mounting panel having at least a first indexing hole; and a card pocket, the card pocket comprising a frame having a rear panel, and at least a first panel engaging clip extending rearwardly from the frame, the panel engaging clip comprising a resiliently deformable member, the resiliently deformable member adapted to extend at least partially through the at least a first indexing hole on the pocket mounting panel and to operatively engage the pocket mounting panel, and the resiliently deformable member comprising a forwardly oriented extension tab that is operatively manually engageable at a surface which is in front of the pocket mounting panel to deform the resiliently deformable member sufficiently to disengage the resiliently deformable member from the indexing hole.

2. The apparatus of claim 1, wherein the card pocket further comprises at least a second panel engaging clip, wherein the pocket mounting panel further comprises at least a second indexing hole, and wherein the first and second panel engaging clips are positioned on the frame so that the resiliently deformable members of the first and second panel engaging clips respectively are aligned to extend at least partially through the first and second indexing holes respectively.

3. The apparatus of claim 2, wherein the first and second panel engaging clips further comprise an extension member having a first end that is operatively affixed to the frame and a second end that is operatively affixed to the resiliently deformable member.

4. The apparatus of claim 3 wherein the extension member extends rearwardly from the frame at an angle of from about 5 degrees to about 30 degrees from vertical with respect to the rear panel of the frame.

5. The apparatus of claim 3, wherein the resiliently deformable member is a U-shaped member.

6. The apparatus of claim 1, wherein the rear panel of the frame includes at least a first access window through which an associated user can operatively manually engage the forwardly oriented extension tab to deform the resiliently deformable member sufficiently to disengage the resiliently deformable member from the indexing hole.

7. The apparatus of claim 1, wherein the rear panel of the frame of the installed card pocket cants forward from the pocket mounting panel at an angle of from between about 5 and about 45 degrees.

8. A display apparatus comprising:

a pocket mounting panel having at least first and second vertically adjacent indexing holes;

at least first and second card pockets, each card pocket comprising a frame having a rear panel, and at least a first panel engaging clip connected to and extending rearwardly from the frame, the panel engaging clip comprising a resiliently deformable member, the resiliently deformable member adapted to extend at least partially through one of the indexing holes on the pocket mounting panel and to operatively engage the pocket mounting panel, and the resiliently deformable member being manually engageable at a surface which is in front of the pocket mounting panel to deform the resiliently deformable member sufficiently to disengage the resiliently deformable member from the indexing hole;

wherein the first pocket card is installed on the pocket mounting panel by means of the engagement of its resiliently deformable member in the first indexing hole and the second pocket card is installed on the pocket mounting panel by means of the engagement of its resiliently deformable member in the second indexing hole; and wherein the first and second card pockets are installed in a vertically cascading arrangement.

9. The apparatus of claim 8, wherein the rear panel of the frame of the first and second card pockets includes at least a first access window through which an associated user can operatively manually engage the resiliently deformable member of each of the first and second installed card pockets sufficiently to disengage the resiliently deformable members from the respective indexing holes.

10. The apparatus of claim 8, wherein the pocket mounting panel further comprises at least a third indexing hole, the first, second and third indexing holes being disposed in a column;

at least a third card pocket installed on the pocket mounting panel by means of the engagement of its resiliently deformable member in the third indexing hole; and wherein the first, second, and third card pockets are installed in a vertically cascading arrangement.

11. The apparatus of claim 10, wherein the first, second, and third card pockets each comprise at least a second panel engaging clip, wherein the pocket mounting panel comprises a plurality of rows and columns of indexing holes, the indexing holes being substantially equally spaced within each column and within each row, and wherein each of the first, second and third card pockets are installed on the pocket mounting panel by means of the engagement of the resiliently deformable members of the first and second panel engaging clips in the adjacent indexing holes on the pocket mounting panel.

12. The apparatus of claim 11, wherein the card pocket that is disposed in the middle of the vertically cascading arrangement of first, second, and third card pockets is removable from the pocket mounting panel without the need to remove either of the vertically adjacent card pockets.

13. The apparatus of claim 12, wherein the card pocket that is disposed in the middle of the vertically cascading arrangement of first, second, and third card pockets is removable from the pocket mounting panel by manually engaging the resiliently deformable members of the middle card pocket sufficiently to disengage the resiliently deformable members from the respective indexing holes, the resiliently deformable members being accessible through the access windows in the rear panels of the middle card pocket and the adjacently lower card pocket.

14. The apparatus of claim 11, wherein the card pocket that is disposed at the vertical top of the of the vertically cascading arrangement of first, second, and third card pockets is manually removable from the pocket mounting panel while the other two pocket cards are installed; and wherein, access to manually remove the card pocket that is disposed at the vertical top of the of the vertically cascading arrangement is provided through access windows in the rear panels of each of the first, second, and third card pockets.

15. The apparatus of claim 8, wherein the frame of each of the first and second card pockets further comprises:

first and second side panels extending forwardly from the rear panel, a bottom panel extending forwardly from the rear panel, a flange extending upwardly from the bottom panel; and wherein the resiliently deformable member is a U-shaped member.

16. The apparatus of claim 15 further comprising at least one paint chip disposed in each of the first and second paint chip pockets.

17. A method for removing a target paint chip pocket in a paint chip display, the method comprising the steps of:

providing a paint chip display comprising a pocket mounting panel, the pocket mounting panel comprising a plurality of rows and columns of indexing holes, the indexing holes being substantially equally spaced within each column and within each row, providing a target paint chip pocket installed on the pocket mounting panel, the target paint chip pocket comprising:

a frame having a rear panel, the rear panel having at least a first access window, and at least a first panel engaging clip connected to and extending rearwardly from the frame, the panel engaging clip comprising a resiliently deformable member, the resiliently deformable member adapted to extend at least partially through one of the indexing holes on the pocket mounting panel and to operatively engage the pocket mounting panel;

manually engaging the resiliently deformable member of the target paint chip pocket at a surface which is in front of the pocket mounting panel and through the at least a first access window in the rear panel of the target paint chip pocket;

deforming the resiliently deformable member sufficiently to disengage the resiliently deformable member from the indexing hole; and removing the resiliently deformable member from the indexing hole.

18. The method of claim 17, wherein the step of providing a target paint chip pocket installed on the pocket mounting panel comprises the step the providing a vertically cascading arrangement of paint chip pockets that includes a target paint chip pocket.

19. The method of claim 18, wherein the target paint chip pocket is positioned vertically above at least one non-target paint chip pocket in the vertically cascading arrangement; and wherein the step of manually engaging the resiliently deformable member of the target paint chip pocket, includes manually engaging the resiliently deformable member of the target paint chip pocket through the at least a first access window in the rear panel of the target paint chip pocket and an access window in the rear panel of the non-target paint chip pocket.

* * * * *